United States Patent [19]

Braden

[11] 4,057,124

[45] Nov. 8, 1977

[54] SOUND SUPPRESSOR

[76] Inventor: Harold C. Braden, 7589 Bear Creek Road, Fairview, Pa. 16415

[21] Appl. No.: 645,417

[22] Filed: Dec. 30, 1975

[51] Int. Cl.[2] ..... F01N 7/00

[52] U.S. Cl. ..... 181/242; 179/188

[58] Field of Search ..... 179/187, 188; 181/21, 181/34, 155

[56] References Cited

U.S. PATENT DOCUMENTS

| | | | |
|---|---|---|---|
| 1,757,463 | 5/1930 | McCann | 179/187 |
| 2,080,552 | 5/1937 | Whittaker et al. | 179/187 |
| 2,106,813 | 2/1938 | Romanow | 179/187 |
| 2,623,957 | 12/1952 | Cragg et al. | 181/34 X |
| 2,846,527 | 8/1958 | Heintzelman | 181/34 X |

*Primary Examiner*—Lawrence R. Franklin
*Attorney, Agent, or Firm*—Charles L. Lovercheck

[57] ABSTRACT

A sound suppressor for a microphone on a low-power transmitter-receiver, sometimes called a citizens band radio. The sound suppressor is made up of a disc of paper-towel-like material and a disc of aluminum foil of like size sandwiched between two annular sheets of aluminum foil with central apertures so that the paper-towel-like disc is exposed from one side and aluminum foil from the other side. The suppressor is supported in front of a microphone so that the sound waves from a person's voice strike the disc. The several discs are held together around the outer periphery of the round discs by pressure-sensitive adhesive.

3 Claims, 5 Drawing Figures

SOUND SUPPRESSOR

GENERAL DESCRIPTION OF INVENTION

In walkie-talkie radios used by truck drivers in highway transportation, the noise from the truck often obscures the voice of the individual. The present invention provides a noise suppressor that will prevent such ambient noise from interfering with the voice.

OBJECTS OF THE INVENTION

It is an object of the invention to provide a sound suppressor for use on walkie-talkie radios and the like.

Another object of the invention is to provide a sound suppressor that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions, and minor details of construction without departing from the spirit or sacrificing any of the advantages of the invention.

GENERAL DESCRIPTION OF DRAWINGS

DETAILED DESCRIPTION OF DRAWINGS

Figure 1:
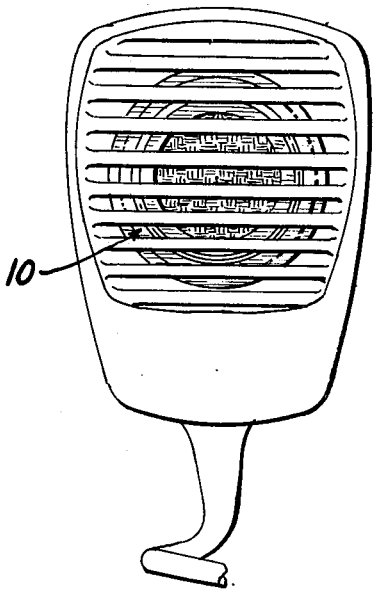
FIG. 1 is a front view of the suppressor shown in a housing according to the invention.
Figure 2:
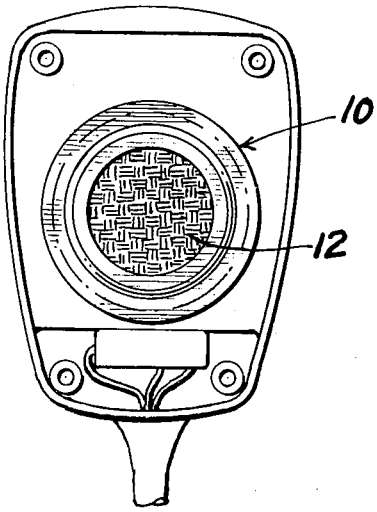
FIG. 2 is a front view of the suppressor shown with the housing cover removed.
Figure 3:
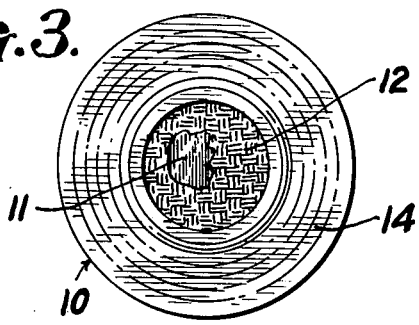
FIG. 3 is a front view of the suppressor shown partly in cross section.
Figure 4:
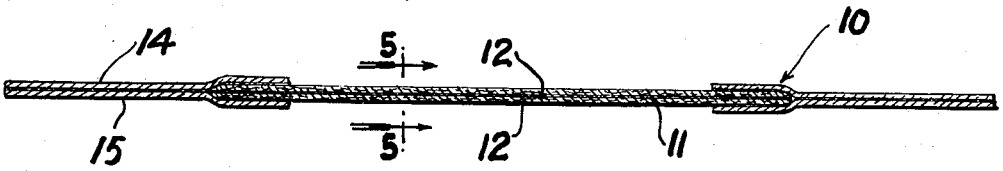
FIG. 4 is a longitudinal cross-sectional view of the suppressor according to the invention.
Figure 5:
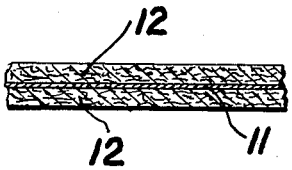
FIG. 5 is an enlarged partial cross-sectional view taken on line 5—5 of FIG. 4.

Now, with more particular reference to the drawings, the sound suppressor is generally indicated at 10 with a round aluminum disc 11 and two round discs 12 made of paper-towel-like material or some other soft, paper-like material supported with the foil material sandwiched between the paper-towel-like material. The paper is a loose mat-type fiber similar to a blotter paper and has rows of deformations in it to increase the sound absorbing area. The paper, supported on both sides of the foil disc, tends to attenuate the noise.

Two annular discs 14 and 15 are supported on each side of the paper-towel-like material. The outer annular discs, the aluminum discs and the paper discs may be held together around the outer periphery by adhesive material.

In use, one of the annular members 14 or 15 is supported against the voice passage in the microphone and it may be held in place by pressure-sensitive adhesive. As an alternative, the entire suppressor could be supported under a metal ring connected to the microphone by means of suitable fasteners.

The foregoing specification sets forth the invention in its preferred practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A sound suppressor for a microphone, said microphone having a voice passage therein, comprising:

two annular sheets of metal foil, each having an opening in the center, a round disc of metallic foil and a round disc of soft, paper-towel-like material resting on each other and sandwiched between said annular sheets of metal foil, concentric with each other and closing said opening in the center and secured to said annular sheets of foil along the periphery of said opening, adhesive material holding said annular sheets together and holding said discs therebetween, and the outside of one said annular sheet of material having pressure-sensitive adhesive thereon for holding said sound suppressor to said microphone over said voice passage.

2. The sound suppressor recited in claim 1 wherein a second round disc of said soft paper is provided and said disc of foil is sandwiched between said first mentioned paper disc and said second paper disc.

3. The sound suppressor recited in claim 2 wherein said paper is deformed to increase the area thereof.

* * * * *